US009740171B2

(12) United States Patent
Nagahama

(10) Patent No.: US 9,740,171 B2
(45) Date of Patent: Aug. 22, 2017

(54) ELECTRONIC TIMEPIECE

(71) Applicant: SEIKO EPSON CORPORATION, Tokyo (JP)

(72) Inventor: Reiko Nagahama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/072,688

(22) Filed: Mar. 17, 2016

(65) Prior Publication Data

US 2016/0299471 A1 Oct. 13, 2016

(30) Foreign Application Priority Data

Apr. 10, 2015 (JP) ..... 2015-081052

(51) Int. Cl.
*G04F 7/00* (2006.01)
*G04B 19/04* (2006.01)
*G04C 3/14* (2006.01)

(52) U.S. Cl.
CPC ..... *G04B 19/04* (2013.01); *G04C 3/14* (2013.01); *G04F 7/00* (2013.01)

(58) Field of Classification Search
CPC ..... G04B 19/04; G04C 3/14; G04C 3/143; G04C 3/146; G04F 7/00
See application file for complete search history.

(56) References Cited

U.S. PATENT DOCUMENTS 4,355,380 A * 10/1982 Huguenin ..... G04C 3/14 368/71
5,959,941 A * 9/1999 Murakami ..... G04C 3/14 368/110
6,367,967 B1 4/2002 Kojima et al.
8,848,491 B2 * 9/2014 Miyake ..... G04C 3/146 368/228
8,971,153 B2 * 3/2015 Takenawa ..... G04C 17/0058 368/35
2013/0033970 A1 * 2/2013 Miyake ..... G04C 3/146 368/80
2014/0036640 A1 * 2/2014 Takenawa ..... G04C 17/0058 368/37
2014/0286138 A1 9/2014 Hasegawa

FOREIGN PATENT DOCUMENTS

JP 2000-230987 A 8/2000
JP 2014-182074 A 9/2014

* cited by examiner

*Primary Examiner* — Sean Kayes
(74) *Attorney, Agent, or Firm* — Global IP Counselors, LLP

(57) ABSTRACT

An electronic timepiece has a plurality of modes and includes a plurality of indicating hands including a first indicating hand as a mode hand that indicates each mode, an operation section that allows mode switching operation that instructs switching among the modes, and a display control section that moves the plurality of indicating hands to be moved on the basis of the mode switching operation in such a way that periods for which the plurality of indicating hands move in high-speed advance action do not overlap with one another. The display control section first moves the first indicating hand among the plurality of indicating hands.

4 Claims, 17 Drawing Sheets

| | FIRST INDICATING HAND | SECOND INDICATING HAND | SUB-HOUR/ MINUTE HAND |
|---|---|---|---|
| NUMBER OF PULSES REQUIRED TO GO AROUND | 300 | 60 | 1440 (=24 HOURS x 60 MINUTES) |
| PERIOD REQUIRED TO GO AROUND (AT 85 Hz) | 3.5 SECONDS | 0.7 SECONDS | 16.9 SECONDS |

| | FIRST INDICATING HAND | SECOND INDICATING HAND | SUB-HOUR/ MINUTE HAND |
|---|---|---|---|
| NUMBER OF PULSES REQUIRED TO GO AROUND | 60 | 300 (=5x60 SECONDS) | 1440 (=24 HOURS x 60 MINUTES) |
| PERIOD REQUIRED TO GO AROUND (AT 85 Hz) | 0.7 SECONDS | 3.5 SECONDS | 16.9 SECONDS |

FIG. 3

| | FIRST INDICATING HAND | SECOND INDICATING HAND | SUB-HOUR/ MINUTE HAND |
|---|---|---|---|
| NUMBER OF PULSES REQUIRED TO GO AROUND | 300 | 60 | 1440 (=24 HOURS x 60 MINUTES) |
| PERIOD REQUIRED TO GO AROUND (AT 85 Hz) | 3.5 SECONDS | 0.7 SECONDS | 16.9 SECONDS |

FIG. 15

ELECTRONIC TIMEPIECE

BACKGROUND

1. Technical Field

The present invention relates to an electronic timepiece including a plurality of pointing hands.

2. Related Art

There is an electronic timepiece of related art capable of advancing a plurality of pointing hands at high speed by moving the pointing hands at different points of time to lower current consumption (see Japanese Patent No. 3,551,861, for example).

The electronic timepiece described in Japanese Patent No. 3,551,861 includes an hour/minute-hand motor that drives the hour and minute hands and a second-hand motor that drives the second hand. In transition from a power saving mode in which the pointing hands are not operated to a display mode in which the pointing hands keep being operated, the hour/minute-hand motor is so controlled that the hour and minute hands are moved in the high-speed advance action to display the hour and minute of the current time and after the hour and minute hands are moved, the second-hand motor is so controlled that the second hand is moved in the high-speed advance action speed to display the second of the current time.

In recent years, there is an electronic timepiece that uses a plurality of common pointing hands to display calendar information, a period measured by a chronograph function, and other types of information. In such an electronic timepiece, when the mode thereof is switched from one to another, each of the pointing hands is moved in the high-speed advance action. In this process, it is conceivable to move the pointing hands at different points of time to lower current consumption, as in the electronic timepiece described in Japanese Patent No. 3,551,861. In this case, however, it is required to allow a user to readily check that the mode has been switched.

SUMMARY

An advantage of some aspects of the invention is to provide an electronic timepiece that allows a user to readily check that the mode of the timepiece has been switched.

An electronic timepiece according to an aspect of the invention is an electronic timepiece having a plurality of modes, the timepiece including a plurality of indicating hands including a mode hand that indicates one of the modes, an operation section that allows mode switching operation that instructs switching among the modes, and a display control section that moves the plurality of indicating hands to be moved on the basis of the mode switching operation in such a way that periods for which the plurality of indicating hands move in high-speed advance action do not overlap with one another, and the display control section first moves the mode hand among the plurality of indicating hands.

According to the aspect of the invention, when the mode switching operation is performed through the operation section, the mode hand, which indicates the mode according to the mode switching operation, first moves. A user can therefore quickly check what mode the mode of the timepiece has switched to, as compared with a case where the mode hand does not first move.

Further, since the indicating hands moved on the basis of the mode switching operation are so moved that the periods for which the indicating hands are moved in high-speed advance action do not overlap with one another, the indicating hands are not simultaneously moved in the high-speed advance action. Current consumption can therefore be lowered as compared with a case where the indicating hands are simultaneously moved in the high-speed advance action.

In a case where indicating hands that do not synchronize with the mode switching operation are provided, these indicating hands are allowed to keep normally operating. For example, hour, minute, and second hands that indicate the current time do not synchronize with the mode switching operation, the hour, minute, and second hands are allowed to keep normally operating.

It is preferable that the electronic timepiece according to the aspect of the invention further includes a plurality of motors that drive the plurality of indicating hands under the control of the display control section, and the display control section first moves the mode hand and then sequentially moves the other indicating hands in ascending order of motor drive pulses required for the indicating hands to go around.

The number of motor drive pulses required for each indicating hand to go around is the number of motor drive pulses required for the hand to make one rotation in a case where the hand is formed of a single hand. In a case where an indicating hand is formed of a plurality of hands that synchronize with one another, such as an hour hand and a minute hand, the number of motor drive pulses is the number of pulses required for all the hands to return to the same position.

When the frequency of the motor drive pulses at the high-speed advance operation is fixed, an indicating hand that requires fewer pulses to go around moves in a shorter period than an indicating hand that requires greater pulses to go around.

Therefore, after the movement of the mode hand, sequentially moving the other indicating hands in ascending order of pulses required for the indicating hands to go around can minimize the average period from the point of time at which the mode switching operation is performed through the operation section to the point of time at which an indicating hand that moves last starts moving.

The user can therefore quickly check that all indicating hands to be moved have started mode switching action, whereby the user's convenience can be improved.

It is preferable that the electronic timepiece according to the aspect of the invention further includes a chronograph section that measures a period, and the plurality of indicating hands include a plurality of measurement indicating hands capable of indicating measured periods measured by the chronograph section, and the display control section moves the mode hand on the basis of chronograph switching operation that is performed through the operation section and instructs measurement of a period, and the display control section, having moved the mode hand, first moves a minimum period measurement indicating hand among the plurality of measurement indicating hands that indicates a minimum period among the measured periods.

According to the aspect of the invention with this configuration, when the chronograph switch operation is performed, the minimum period measurement indicating hand, such as a chronograph second hand, first moves after the mode hand moves.

Therefore, when the chronograph section starts measuring a period immediately after the chronograph switching operation is performed, the period spent until the minimum period of the measured period is displayed can be shortened as compared with a case where the minimum period measurement indicating hand moves after a chronograph minute hand, a chronograph hour hand, and other measurement indicating hands move, whereby the user can quickly check the minimum period.

In the electronic timepiece according to the aspect of the invention, it is preferable that, when the chronograph section starts measuring a period before the movement of the minimum period measurement indicating hand is completed, the display control section moves the minimum period measurement indicating hand in the high-speed advance action to a position representing the measured period and then allows the minimum period measurement indicating hand to normally operate.

According to the aspect of the invention with this configuration, when the chronograph section starts measuring a period before the minimum period measurement indicating hand is moved to a measurement start position, the measured period can be quickly displayed as compared, for example, with a case where all the measurement indicating hands are moved to the measurement start position (return-to-zero position) and then the minimum period measurement indicating hand is allowed to indicate the measured period.

An electronic timepiece according to another aspect of the invention is an electronic timepiece having a plurality of modes, the timepiece including a plurality of indicating hands, a plurality of motors that drive the plurality of indicating hands, an operation section that allows mode switching operation that instructs switching among modes, and a display control section that moves the plurality of indicating hands in high-speed advance action by using the plurality of motors on the basis of the mode switching operation, and the display control section sequentially moves the plurality of indicating hands in ascending order of motor drive pulses required for the indicating hands to go around in such a way that periods for which the indicating hands move do not overlap with one another.

According to the aspect of the invention, sequentially moving the indicating hands in ascending order of pulses required for the indicating hands to go around can minimize the average period from the point of time at which the mode switching operation is performed through the operation section to the point of time at which an indicating hand that moves last starts moving.

The user can therefore quickly check that all indicating hands to be moved have started mode switching action, whereby the user's convenience can be improved.

Further, since the indicating hands are not simultaneously moved in the high-speed advance action, current consumption can be lowered as compared with a case where the indicating hands are simultaneously moved in the high-speed advance action.

BRIEF DESCRIPTION OF THE DRAWINGS

The invention will be described with reference to the accompanying drawings, wherein like numbers reference like elements.

FIG. 3 shows the number of pulses required for each indicating hand of the analog electronic timepiece according to the first embodiment to go around and further shows a period required for the indicating hand to move.

FIG. 15 shows the number of pulses required for each indicating hand of the analog electronic timepiece according to the fourth embodiment to go around and further shows a period required for the indicating hand to move.

DESCRIPTION OF EXEMPLARY EMBODIMENTS

First Embodiment

Figure 1:
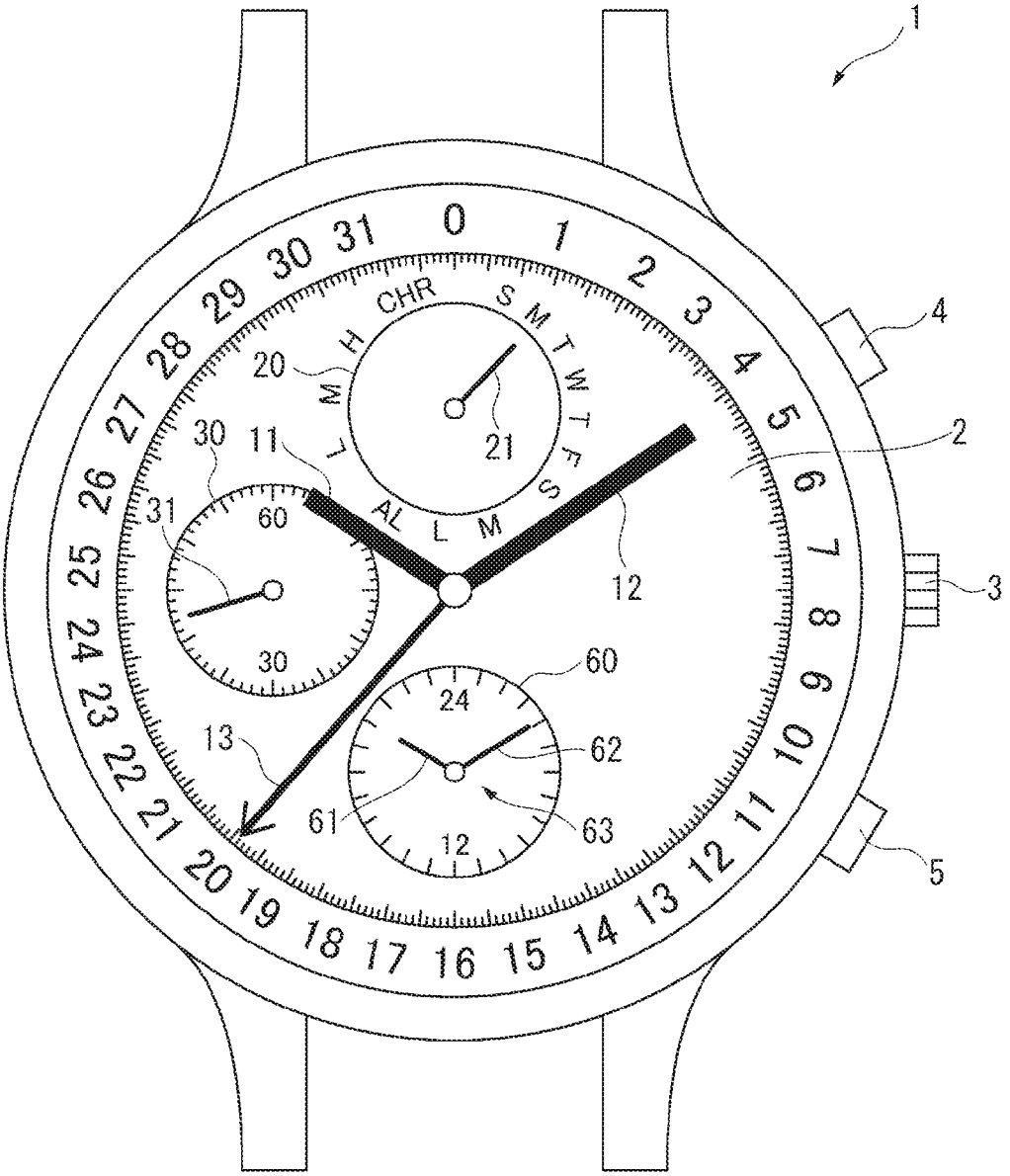
FIG. 1 is a front view of an analog electronic timepiece according to a first embodiment of the invention.

FIG. 1 is a front view of an analog electronic timepiece 1. The analog electronic timepiece 1 forms a timepiece according to the invention.

The analog electronic timepiece 1 includes a circular dial 2, as shown in FIG. 1. The dial 2 is provided with a first small circular window 20 in a position shifted from the center of the dial 2 in the 12-o'clock direction when viewed from the front side of the timepiece, a second small circular window 30 in a position shifted from the center of the dial 2 in the 9-o'clock direction, and a third small circular window 60 in a position shifted from the center of the dial 2 in the 6-o'clock direction.

The analog electronic timepiece 1 further includes an hour hand 11, a minute hand 12, and a second hand 31, which serve as pointing hands for a basic timepiece and perform typical time display. The hour hand 11 and the minute hand 12 have an axis of rotation located at the center of the dial 2. The second hand 31 is disposed in the second small window 30. The hour hand 11, the minute hand 12, and the second pointing hand 31 form time hands according to the invention.

The analog electronic timepiece 1 further includes a second pointing hand 13, which is a center hand having an axis of rotation located at the center of the dial 2.

Numerals 0 to 31 are written on the peripheral surface of the dial 2 along the outer circumference thereof. The numerals 0 to 31 are sequentially arranged clockwise from the 12-o'clock position when viewed from the front side of the timepiece. The second pointing hand 13 points one of the numerals to indicate a value of any of the following types of calendar information: the date; the month; and years elapsed from a leap year (0, +1 to +3).

Markings that divide the outer circumference into 60 divisions and ⅕ markings that divide each of the divisions are further written on the peripheral surface of the dial 2 along the inner side of the numerals 0 to 31. The second indicating hand 13 uses these markings to indicate the second of a measured period measured by a chronograph section 582, which will be described later, on a ⅕-second basis. The second indicating hand 13 forms a minimum period measurement indicating hand according to the invention.

The analog electronic timepiece 1 further includes a first indicating hand 21 as a mode hand disposed in the first small window 20. Letters "S", "M", "T", "W", "T", "F", and "S", which represent the seven days of the week, Sunday to Saturday, are written around the first small window 20. The first indicating hand 21 points one of "S" to "S", which represent the seven days of the week, to indicate the day of the week. The first indicating hand 21 points one of "S" to "S" to indicate that the mode of the timepiece is a normal display mode.

A letter "M", which represents the month, and a letter "L", which represents elapsed years, are further written around the first small window 20. The first indicating hand 21 points "M" to indicate that the mode of the timepiece is a month display mode in which the month is displayed and points "L" to indicate that the mode of the timepiece is an elapsed year display mode in which the elapsed years is displayed.

Letters "AL", which represent an alarm function, are further written around the first small window 20. The first indicating hand 21 points "AL" to indicate that the mode of the timepiece is an alarm time setting mode in which alarm time can be set.

Letters "L", "M", and "H", which represent the charge level of a secondary battery 7 (see FIG. 2), are further written around the first small window 20. The first indicating hand 21 points "L" to indicate a low charge level, points "M" to indicate a middle charge level, and points "H" to indicate a high charge level. The first indicating hand 21 points one of "L", "M", and "H" to indicate that the mode of the timepiece is a charge level display mode in which the charge level is displayed.

Letters "CHR", which represent a chronograph function, are further written around the first small window 20. The first indicating hand 21 points "CHR" to indicate that the mode of the timepiece is a chronograph mode in which a period can be measured.

The analog electronic timepiece 1 further includes a sub-hour/minute hand 63 formed of a sub-hour hand 61 and a sub-minute hand 62 disposed in the third small window 60. The sub-hour/minute hand 63 indicates the alarm time or the hour and minute of a measured period measured by the chronograph section 582, which will be described later. The sub-hour/minute hand 63 indicates the alarm time and the measured period in the 24-hour clock. The sub-hour/minute hand 63 forms a measurement hand according to the invention.

The analog electronic timepiece 1 further includes a crown 3, an A button 4, and a B button 5. The crown 3, the A button 4, and the B button 5 form an operation section according to the invention.

Figure 2:
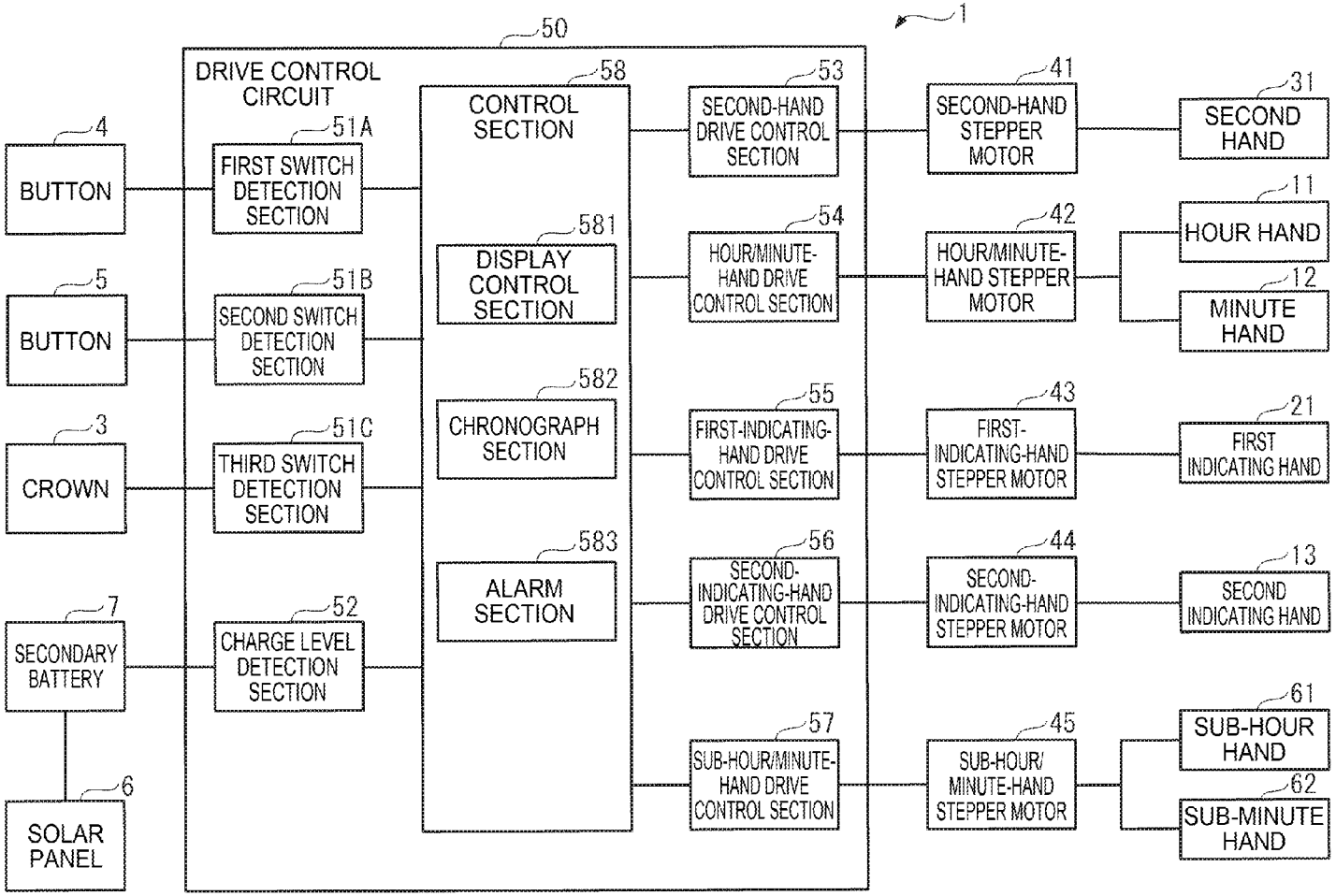
FIG. 2 is a block diagram showing the configuration of the analog electronic timepiece according to the first embodiment.

FIG. 2 is a block diagram showing the configuration of the analog electronic timepiece 1.

The indicating hands 11-13, 21, 31, 61, and 62 are driven with five stepper motors, as shown in FIG. 2. That is, the second hand 31 is driven with a second-hand stepper motor 41. The hour hand 11 and the minute hand 12 are driven with an hour/minute-hand stepper motor 42. The first indicating hand 21 is driven with a first-indicating-hand stepper motor 43. The second indicating hand 13 is driven with a second-indicating-hand stepper motor 44. The sub-hour/minute hand 63 (sub-hour hand 61 and sub-minute hand 62) is driven with a sub-hour/minute-hand stepper motor 45. Each of the stepper motors forms a motor according to the invention. The hour hand 11, the minute hand 12, and the second hand 31 may instead be driven with a common stepper motor.

The hour hand 11, the minute hand 12, the second hand 31, the first indicating hand 21, and the second indicating hand 13 are configured to be rotatable in a normal direction (clockwise), and the sub-hour/minute hand 63 is configured to be rotatable in the normal direction and a reverse direction (counterclockwise). The hour hand 11, the minute hand 12, the second hand 31, the first indicating hand 21, and the second indicating hand 13 may instead be configured to be rotatable in the formal and reverse directions.

The analog electronic timepiece 1 further includes a solar panel 6, which is a power generator, and the secondary battery 7, to which electric energy generated with the solar panel 6 is charged. The secondary battery 7 forms a power supply of the analog electronic timepiece 1.

The analog electronic timepiece 1 has a built-in drive control circuit 50 to drive and control the stepper motors 41 to 45.

The drive control circuit 50 includes a first switch detection section 51A, a second switch detection section 51B, a third switch detection section 51C, a charge level detection section 52, a control section 58, a second-hand drive control section 53, an hour/minute-hand drive control section 54, a first-indicating-hand drive control section 55, a second-indicating-hand drive control section 56, and a sub-hour/minute-hand drive control section 57. The control section 58 carries out a variety of processes in the analog electronic timepiece 1 and includes a display control section 581, the chronograph section 582, and an alarm section 583.

The first switch detection section 51A detects operation of pushing the A button 4, and when the A button 4 is pushed, the first switch detection section 51A outputs a detection signal indicating that the A button 4 has been pushed to the control section 58.

The second switch detection section 51B detects operation of pushing the B button 5, and when the B button 5 is pushed, the second switch detection section 51B outputs a detection signal indicating that the B button 5 has been pushed to the control section 58.

The third switch detection section 51C detects operation of the crown 3, and when the crown 3 is operated, the third switch detection section 51C outputs a detection signal according to the operation to the control section 58.

The charge level detection section 52 detects the charge level of the secondary battery 7 (remainder of battery capacity). The detection of the charge level is performed, for example, at fixed time intervals.

The display control section 581 controls the second-hand drive control section 53, the hour/minute-hand drive control section 54, the first-indicating-hand drive control section 55, the second-indicating-hand drive control section 56, and the sub-hour/minute-hand drive control section 57 to cause them to move the indicating hands.

The second-hand drive control section 53 uses a reference signal (1-Hz signal, for example) outputted from a reference signal generation circuit, such as a quartz oscillator, to output motor drive pulses so as to control the second-hand stepper motor 41 to control the drive operation of the second hand 31.

The hour/minute-hand drive control section 54 uses the reference signal to output motor drive pulses so as to control the hour/minute-hand stepper motor 42 to control the drive operation of the hour hand 11 and the minute hand 12.

The first-indicating-hand drive control section 55 uses the reference signal to output motor drive pulses so as to control the first-indicating-hand stepper motor 43 to control the drive operation of the first indicating hand 21.

The second-indicating-hand drive control section 56 uses the reference signal to output motor drive pulses so as to control the second-indicating-hand stepper motor 44 to control the drive operation of the second indicating hand 13.

The sub-hour/minute-hand drive control section 57 uses the reference signal to output motor drive pulses so as to control the sub-hour/minute-hand stepper motor 45 to control the drive operation of the sub-hour hand 61 and the sub-minute hand 62.

How the display control section 581 moves the indicating hands will be described in detail in the description of display switching action, which will be described later.

The chronograph section 582 operates when the B button 5 is pressed in any of display states, a state 1 to a state 5, which will be described later, and starts measuring a period when the A button 4 is pressed. When the A button 4 is pressed again, the chronograph section 582 stops measuring the period.

The alarm section 583 detects that the current time has reached preset alarm time and notifies a user of the alarm time by using a buzzer that is not shown but is provided in the analog electronic timepiece 1.

Period Required to Move Each Indicating Hand

FIG. 3 shows the number of motor drive pulses required for each of the first indicating hand 21, the second indicating hand 13, and the sub-hour/minute hand 63 to go around and further shows the period required for each of the hands to go around in the high-speed advance action. The first indicating hand 21 going around means that the first indicating hand 21 making one rotation. The second indicating hand 13 going around means that the second indicating hand 13 making one rotation. The sub-hour/minute hand 63 going around means that both the sub-hour hand 61 and the sub-minute hand 62 rotating in one direction and returning to the same position. In the present embodiment, when the sub-minute hand 62 makes 24 rotations, the sub-hour hand 61 makes one rotation, and the sub-hour/minute hand 63 goes around.

The high-speed advance operation means driving each of the indicating hands with motor drive pulses in a fast advance mode. For example, the speeds at which the second indicating hand 13 and the sub-hour/minute hand 63 are operated in the high-speed advance action are greater than the speed at which these hands are operated to indicate a measured period.

FIG. 3 shows a case where each of the indicating hands is advanced at high speed with motor drive pulses of a frequency of 85 Hz.

The number of pulses required for the first indicating hand 21 to go around is 60, and the period required for the first indicating hand 21 to go around in the high-speed advance action is about 0.7 seconds (60/85 Hz).

The number of pulses required for the second indicating hand 13, which points the divisions over 60 seconds at a ⅕-second increment, to go around is 300 (5×60 seconds), and the period required for the second indicating hand 13 to go around in the high-speed advance action is about 3.5 seconds (300/85 Hz).

Since the sub-hour hand 61 makes one rotation when the sub-minute hand 62 makes 24 rotations, and the number of pulses required for the sub-minute hand 62 to make one rotation is 60, the number of pulses required for the sub-hour/minute 63 to go around is 1440 (24 hours×60 minutes), and the period required for the sub-hour/minute hand 63 to go around in the high-speed advance action is about 16.9 seconds (1440/85 Hz).

That is, in the high-speed advance action, the first indicating hand 21 goes around in the shortest period, the second indicating hand 13 goes around in the second shortest period, and the sub-hour/minute hand 63 goes around in the longest period.

Mode Switch Action

In the analog electronic timepiece 1, when the A button 4 is pressed, the mode of the timepiece is sequentially switched. That is, the operation of pressing the A button 4 is mode switch operation according to the invention.

Further, in the analog electronic timepiece 1, when the B button 5 is pressed, the mode of the timepiece transitions to the chronograph mode. That is, the operation of pressing the B button 5 is the mode switch operation according to the invention and chronograph mode switch operation.

Mode Switch Action in the Case where A Button is Pressed

Figure 4:
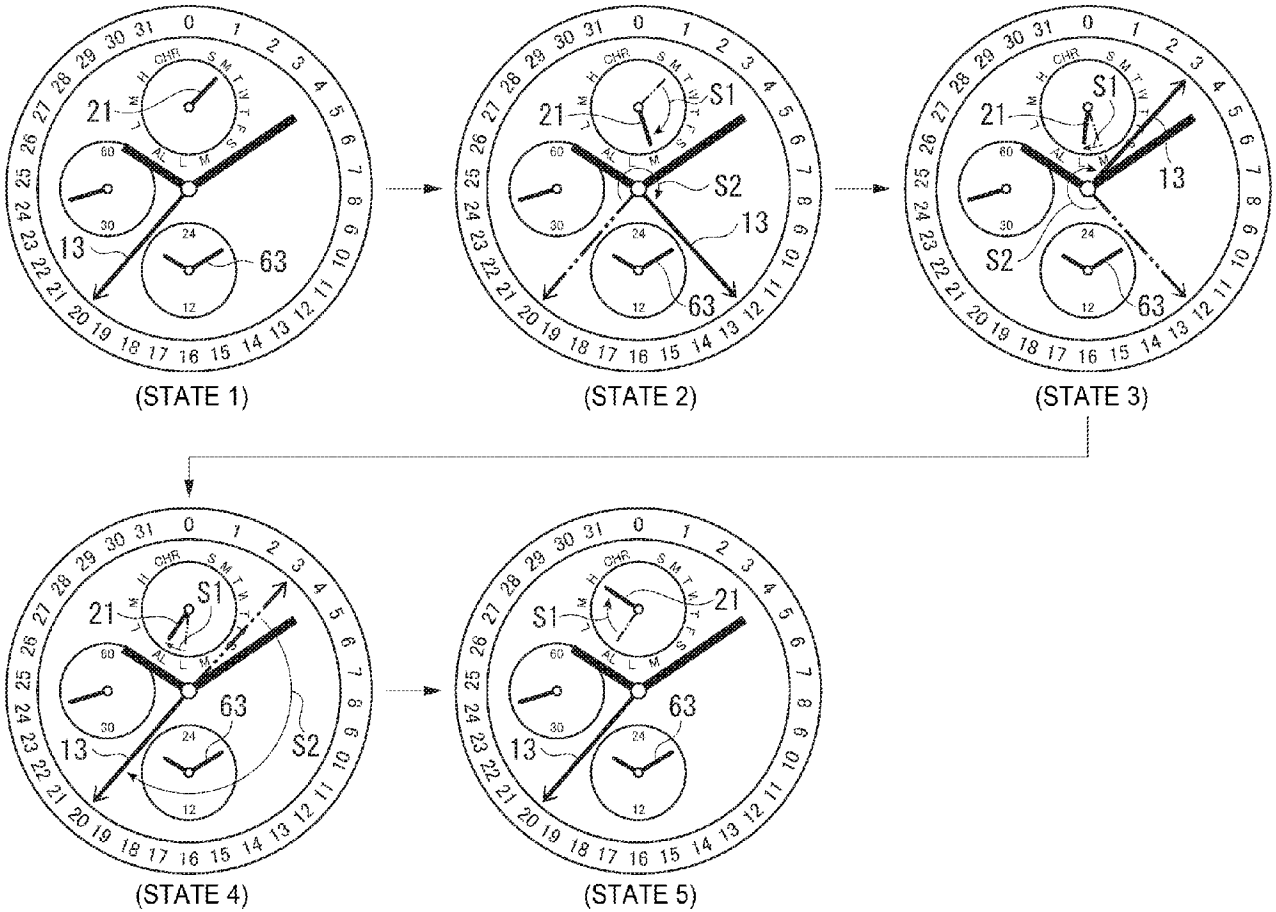
FIG. 4 shows an example of transition of a display state in a case where an A button of the analog electronic timepiece according to the first embodiment is pressed.

In a normal display state, the indicating hands 11, 12, and 31 indicate the hour, minute, and second of the current time, the first indicating hand 21 indicates the day of the week, the second indicating hand 13 indicates the current date (20-th in state 1 in FIG. 4), and the sub-hour/minute hand 63 indicates, when any alarm time has been set, the hour and minute of the alarm time, whereas indicating the hour and minute of the current time when no alarm time has been set, as shown in the state 1 in FIG. 4. When the A button 4 is pressed, the indicating hands 11, 12, and 31 keep operating at a normal speed and indicating the hour, minute, and second of the current time, and the sub-hour/minute hand 63 keeps indicating the alarm time or the hour and minute of the current time.

When the A button 4 is pressed in the state 1, the first indicating hand 21 moves clockwise in the high-speed advance action and points "M", which represents the month, as shown in a state 2. The second indicating hand 13 then moves clockwise in the high-speed advance operation and indicates the current month (December in state 2 in FIG. 4).

When the A button 4 is pressed in the state 2, the first indicating hand 21 moves clockwise in the high-speed advance action and points "L", which represents the elapsed years, as shown in a state 3. The second indicating hand 13 then moves clockwise in the high-speed advance action and indicates the value of the current elapsed years (three years in state 4 in FIG. 4).

When the A button 4 is pressed in the state 3, the first indicating hand 21 moves clockwise in the high-speed advance action and points "AL", which represents the alarm function, as shown in the state 4. The second indicating hand 13 then moves clockwise in the high-speed advance action and indicates the current date (20-th in state 4 in FIG. 4).

In this display state, the user can rotates the crown 3 to move the sub-hour/minute hand 63 to shift it from the current time and set alarm time. Further, the user can so move the sub-hour/minute hand 63 as to coincide with the current time to cancel the setting of the alarm time.

The setting of alarm time may be performed by button operation instead of rotation of the crown 3. For example, the user may adjust the alarm time by pulling the crown 3 to a first-step position and pressing the A button 4 to rotate the sub-hour/minute hand 63 in the normal direction or pressing the B button 5 to rotate the sub-hour/minute hand 63 in the reverse direction and set the alarm time by pushing the crown 3 to a zeroth-step position.

When the A button 4 is pressed in the state 4, the first indicating hand 21 moves clockwise in the high-speed advance action and indicates the charge level, as shown in a state 5. The second indicating hand 13 keeps indicating the current date.

When the A button 4 is pressed in the state 5, the first indicating hand 21 moves clockwise in the high-speed advance action and indicates the day of the week, as shown in the state 1. The second indicating hand 13 keeps indicating the current date. The display state thus returns to the normal display state.

Mode Switch Action in the Case where B Button is Pressed

When the B button 5 is pressed in any of the states 1 to 5, the mode of the timepiece is switched to the chronograph mode.

Figure 5:
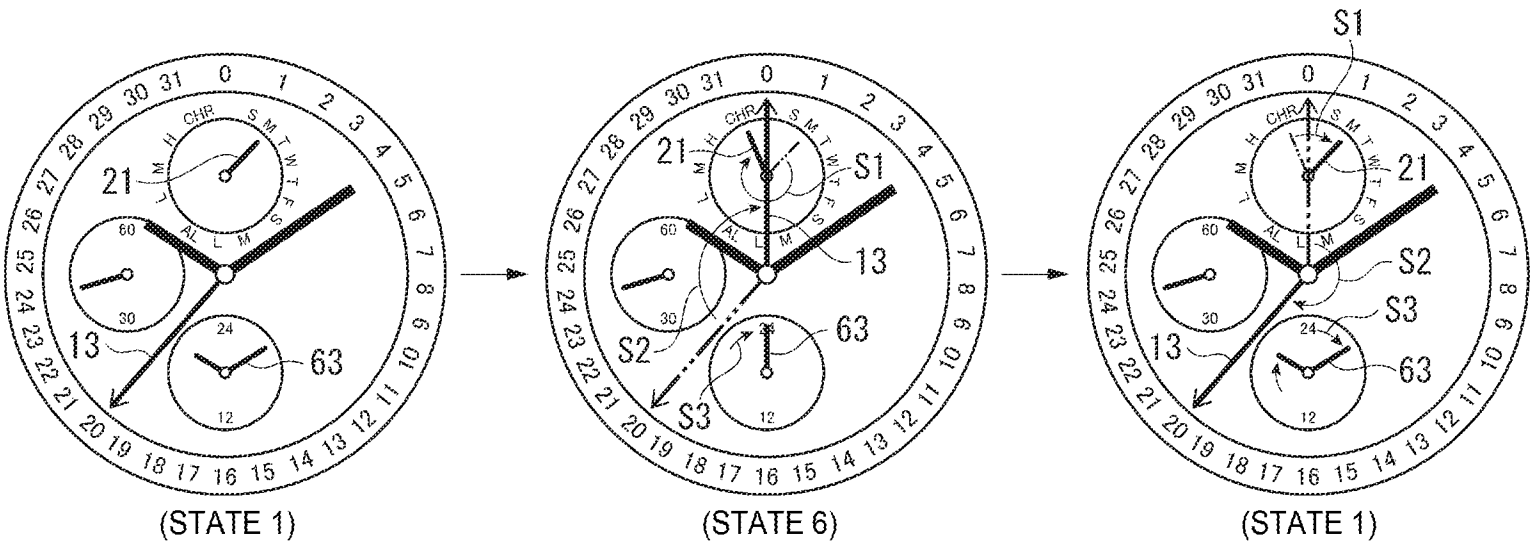
FIG. 5 shows an example of transition of the display state in a case where a B button of the analog electronic timepiece according to the first embodiment is pressed.

FIG. 5 shows an example of transition of the display state in a case where the B button 5 is pressed in the state 1.

When the B button 5 is pressed, the first indicating hand 21 moves clockwise in the high-speed advance action and points "CHR", which represents the chronograph function, as shown in a state 6 in FIG. 5.

After the first indicating hand 21 moves in the high-speed advance action, the second indicating hand 13 moves clockwise in the high-speed advance action to the 0-second position (return-to-zero position).

After the second indicating hand 13 moves in the high-speed advance action to the return-to-zero position, the sub-hour/minute hand 63 moves in the high-speed advance action to the 0-hour/minute position (return-to-zero position). The sub-hour/minute hand 63 moves in the clockwise or counterclockwise direction which allows the sub-hour/minute hand 63 to move to the 0-hour/minute position faster.

When the A button 4 is pressed so that the chronograph section 582 starts measurement, the second indicating hand 13 and the sub-hour/minute hand 63 operate at the normal speed and indicate the second, minute, and hour of the measured period.

The hour hand 11, the minute hand 12, and the second hand 31 keep moving at the normal speed and indicating the hour, minute, and second of the current time.

The period from the point of time at which the B button 5 is pressed to the point of time at which the second indicating hand 13 moves to the 0-second position is about 4.2 seconds (0.7 seconds+3.5 seconds) at the longest. Therefore, when the A button 4 is pressed immediately after the B button 5 is pressed so that the chronograph section 582 starts measurement, the second of the measured period has advanced in some cases before the second indicating hand 13 moves to the 0-second position.

Figure 6:
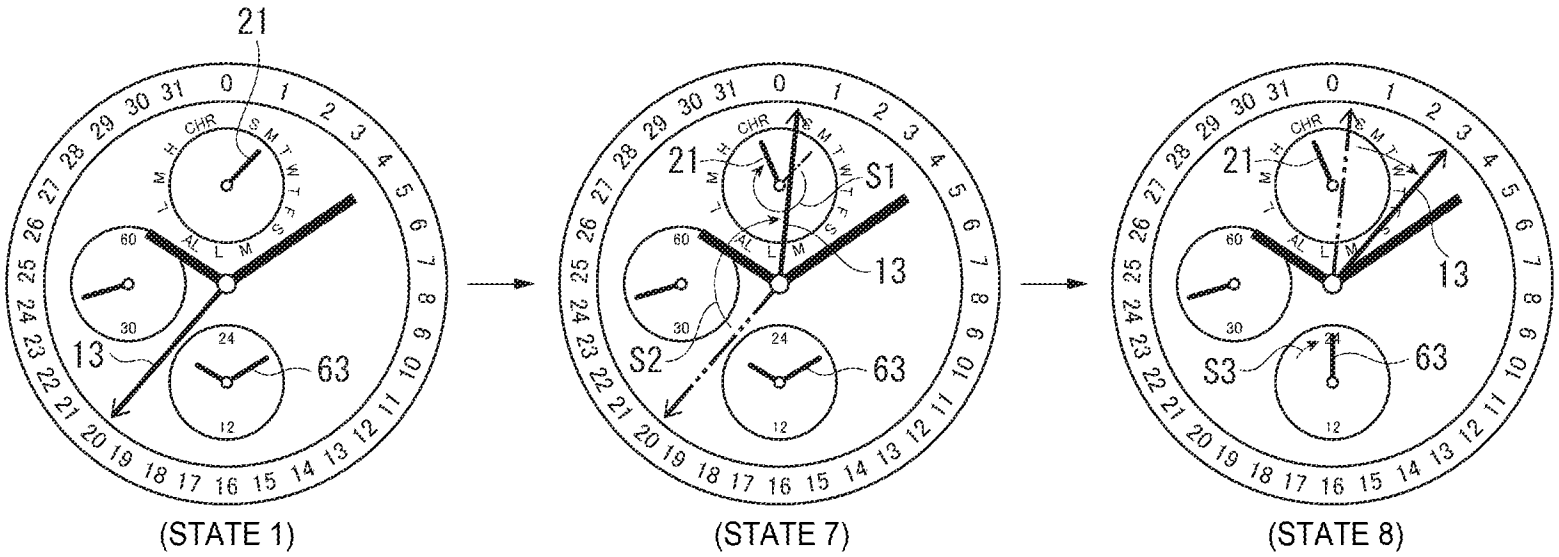
FIG. 6 shows another example of transition of the display state in the case where the B button of the analog electronic timepiece according to the first embodiment is pressed.

In this case, the second indicating hand 13 does not stop at the return-to-zero position but moves in the high-speed advance action to the position that represents the second of the measured period, as shown in a state 7 in FIG. 6. Having moved in the high-speed advance action to the position that represents the second of the measured period, the second indicating hand 13 keeps operating at the normal speed and indicating the second of the measured period, as shown in a state 8.

At the timing when the action of the second indicating hand 13 is switched from the movement in the high-speed advance action to the normal hand operation, the sub-hour/minute hand 63 starts moving to the 0-hour/minute position (return-to-zero position) in the high-speed advance action. The period from the point of time at which the B button 5 is pressed to the point of time at which the sub-hour/minute hand 63 moves to the 0-hour/minute position is about 21.1 seconds (4.2 seconds+16.9 seconds) at the longest. Therefore, since the minute of the measured period does not reach 1 minute before the sub-hour/minute hand 63 moves to the 0-hour/minute position, the sub-hour/minute hand 63 points the 0-hour/minute position, as shown in the state 8. Thereafter, when the measured period reaches or exceeds 1 minute, the sub-hour/minute hand 63 operates at the normal speed and indicates the hour and minute of the measured period.

When the sub-hour/minute hand 63 moves in the high-speed advance action, the second indicating hand 13 also moves, but an increase in current consumption falls within an acceptable range because the second indicating hand 13 is normally operated.

When the B button 5 is pressed again, the first indicating hand 21, the second indicating hand 13, and the sub-hour/minute hand 63 return to the display state before the B button 5 was pressed for the first time, as shown in FIG. 5. In this process, the first indicating hand 21 first moves in the high-speed advance action, the second indicating hand 13 then moves in the high-speed advance action, and the sub-hour/minute hand 63 finally moves in the high-speed advance action.

Advantageous Effects of First Embodiment

When the A button 4 or the B button 5 is pressed, the first indicating hand 21 first moves as the mode hand. The user can therefore quickly check what mode the mode of the timepiece has switched to, as compared with a case where the first indicating hand 21 does not first move.

As for the second indicating hand 13 and the sub-hour/minute hand 63, which is advanced at high speed after the first indicating hand 21 moves, since the second indicating hand 13, which goes around with a fewer number of motor drive pulses, is first advanced at high speed, and lastly, the sub-hour/minute hand 63 is advanced at high speed, the average period to the timing at which the indicating hand that moves last starts moving can be shortened as compared with a case where these hands move in the reversed order.

Similarly, the first indicating hand 21, the second indicating hand 13, and the sub-hour/minute hand 63 are advanced at high speed in this order or in ascending order of the number of motor drive pulses required for the hands to go around, the average period from the timing at which the mode switch operation is performed to the timing at which the indicating hand that moves last starts moving can be shortened as compared with a case where the hands move in a different order. The user can therefore quickly check that all indicating hands to be moved have started mode switch action.

Further, since the periods for which the first indicating hand 21, the second indicating hand 13, and the sub-hour/minute hand 63 advanced at high speed do not overlap with each other, the current consumption can be lowered as compared with a case where the hands simultaneously move in the high-speed advance action, whereby the burden on the power supply can be lowered. In a case where a power supply that undergoes charging and discharging, such as a secondary battery, is used, as in the analog electronic timepiece 1, when current consumption is high, not only is the burden on the power supply high and a voltage drop, for example, occurs, but also the drive control circuit is also greatly affected. In addition, in analog electronic timepieces in recent years, an indicating hand is frequently rotated counterclockwise to impart variation to the motion of the indicating hand, and a stepper motor is therefore frequently driven in the reversed direction in high-speed advance action. When a stepper motor is driven in the reversed direction, the current consumption is higher than when the stepper motor is driven in the normal direction, and the burden on the power supply therefore tends to increase. The configuration described above capable of reducing the burden on the power supply is therefore particularly effective.

When the chronograph switch operation is performed, the second indicating hand 13, which indicates the second of a measured period, first moves after the first indicating hand 21 moves. Therefore, when the chronograph section 582 starts measuring a period immediately after the chronograph switching operation is performed, the period spent until the second of the measured period is displayed can be shortened as compared with a case where the second indicating hand 13 moves after the sub-hour/minute hand 63 moves, whereby the user can quickly check the second of the measured period.

Further, when the chronograph section 582 starts measuring a period before the second indicating hand 13 moves to the 0-second position, the second indicating hand 13 is moved in the high-speed advance action to the position that represents the second of the measured period and then normally operated. The second of the measured period can thus be quickly displayed as compared with a case where the second indicating hand 13 is moved to the 0-second position, the sub-hour/minute hand 63 is moved to the 0-hour/minute position, and then the second indicating hand 13 is allowed to indicate the second of the measured period.

Since the hour hand 11, the minute hand 12, and the second hand 31 keep operating at the normal speed and indicating the hour, minute, and second of the current time even in a case where a mode other than the normal mode is chosen, the user can always check the current time.

Second Embodiment

An analog electronic timepiece 1A according to a second embodiment will be described. In the analog electronic timepiece LA, the same configurations as those of the analog electronic timepiece 1 according to the first embodiment will not be described.

Figure 7:
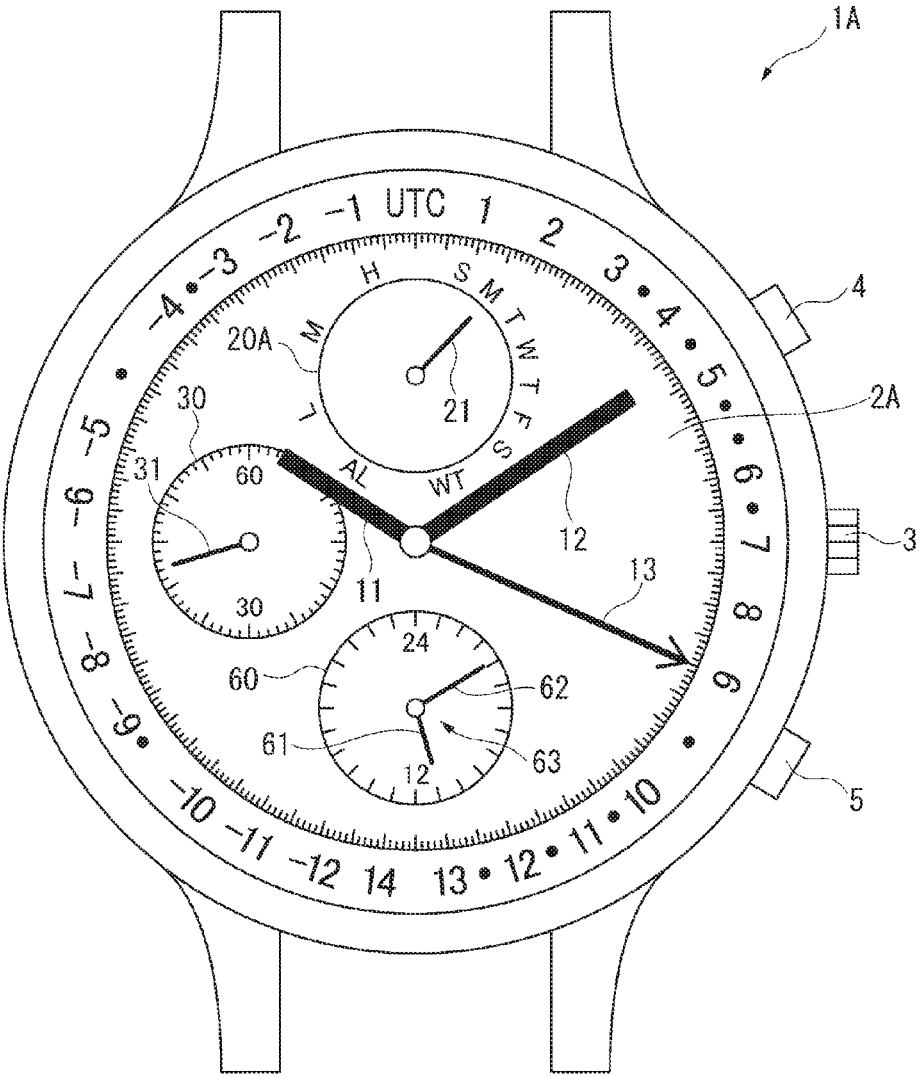
FIG. 7 is a front view of an analog electronic timepiece according to a second embodiment of the invention.

In the analog electronic timepiece 1A, time difference information representing the time difference from the coordinated universal time (UTC) are written in the form of numerals and midpoints (●) on the peripheral surface of a dial 2A, as shown in FIG. 7. The numeral time difference information is formed of integer time differences, and the midpoint time difference information shows that it is formed of time differences other than the integer time differences. The second indicating hand 13 points any of the numerals and the midpoints to indicate the time difference from UTC. In place of the time difference, city information representing names of representative cities each located in a time zone in which standard time corresponding to the time difference is used may be written, and the second indicating hand 13 may point any location in the city information to indicate the time difference from UTC.

Letters "WT" representing a world time setting function are written around a first small window 20A as well as "S" to "S" representing the seven days of the week, "AL" representing the alarm function, and "L", "M", and "H" representing the charge level. The first indicating hand 21 points "WT" to indicate that the mode of the timepiece is a world time setting mode, which allows world time setting.

The sub-hour/minute hand 63 indicates the world time as well as alarm time and a measured period measured by the chronograph section 582. The world time is time in a time zone corresponding to a chosen time difference.

Figure 8:
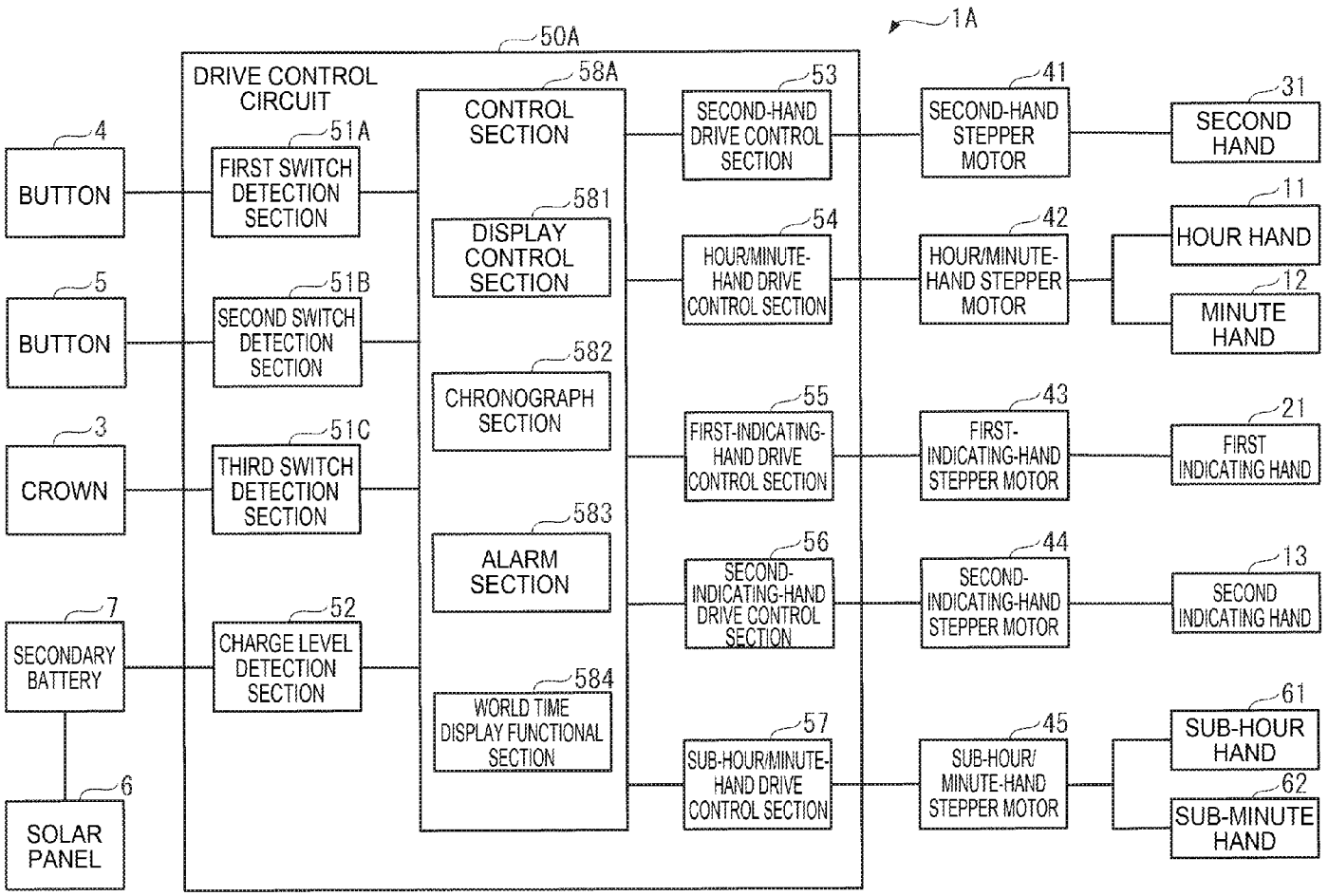
FIG. 8 is a block diagram showing the configuration of an analog electronic timepiece according to the second embodiment.

FIG. 8 is a block diagram showing the configuration of the analog electronic timepiece 1A.

A control section 58A in a drive control circuit 50A includes a world time setting functional section 584 as well as the display control section 581, the chronograph section 582, and the alarm section 583, as shown in FIG. 8.

The world time setting functional section 584 calculates and acquires the time in the time zone corresponding to a chosen time difference (world time).

In the analog electronic timepiece 1A, the number of motor drive pulses required for each of the first indicating hand 21, the second indicating hand 13, and the sub-hour/minute hand 63 to go around and the period required for each of the hands to go around in the high-speed advance action are equal to those in the analog electronic timepiece 1 according to the first embodiment.

Mode Switch Action in the Case where A Button is Pressed

Figure 9:
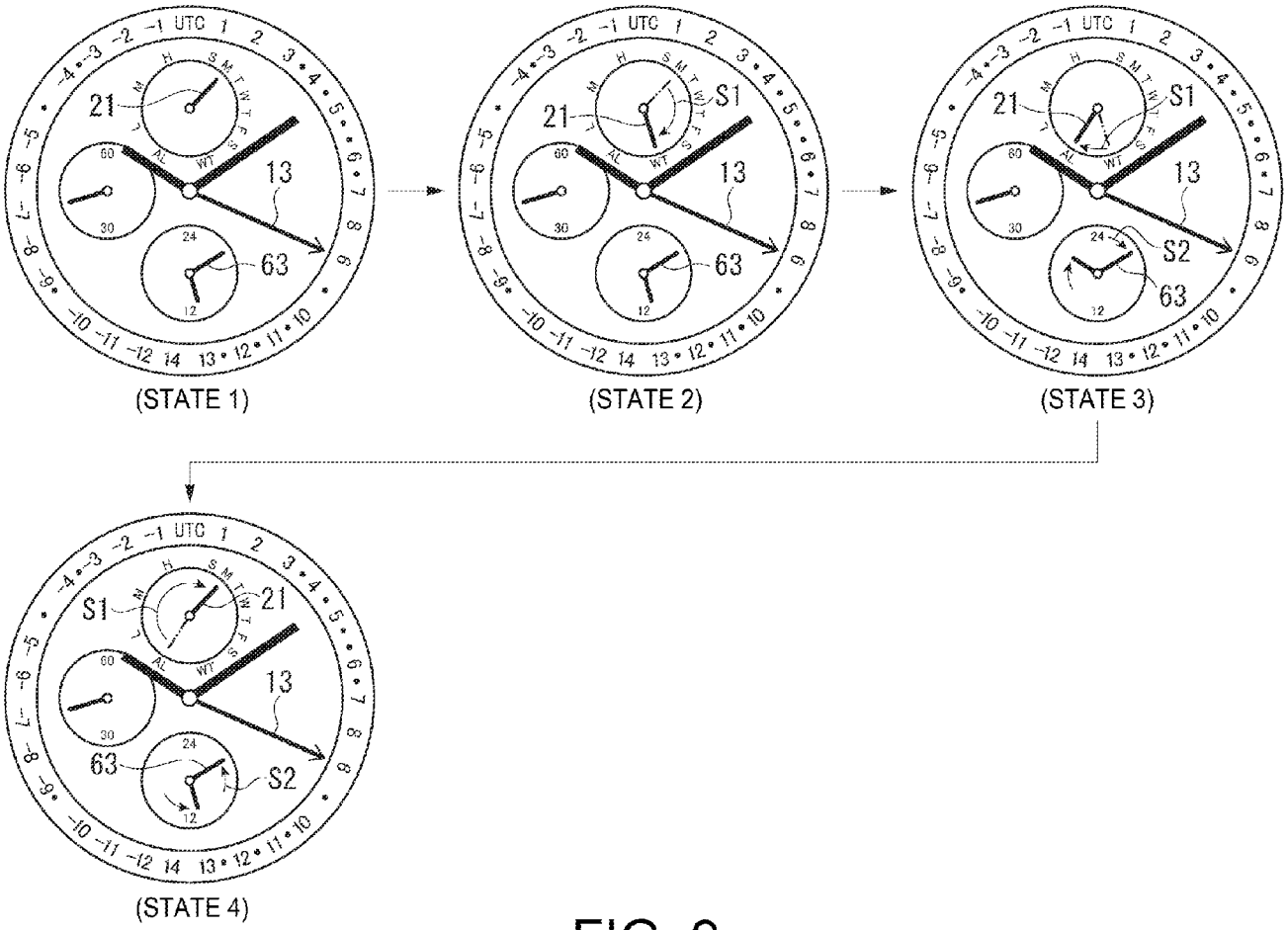
FIG. 9 shows an example of transition of the display state in a case where the A button of the analog electronic timepiece according to the second embodiment is pressed.

In the normal display state, the indicating hands 11, 12, and 31 indicate the hour, minute, and second of the current time, the first indicating hand 21 indicates the day of the week, the second indicating hand 13 indicates a set time difference, and the sub-hour/minute hand 63 indicates the hour and minute of the world time, as shown in a state 1 in FIG. 9. Even when the A button 4 is pressed, the indicating hands 11, 12, and 31 keep operating at the normal speed and indicating the hour, minute, and second of the current time, and the second indicating hand 13 keeps indicating the time difference.

When the A button 4 is pressed, the first indicating hand 21 moves clockwise in the high-speed advance action and points "WT", which represents the world time setting function, as shown in a state 2. The sub-hour/minute hand 63 keeps indicating the hour and minute of the world time.

In the state 2, the user can set a time difference by rotating the crown 3 to move the second indicating hand 13 and then pressing the A button 4.

When the A button 4 is pressed in the state 2, the first indicating hand 21 moves clockwise in the high-speed advance action and points "AL", which represents the alarm function, as shown in a state 3. The sub-hour/minute hand 63 then moves clockwise in the high-speed advance action and indicates the hour and minute of alarm time.

When the A button 4 is pressed in the state 3, the first indicating hand 21 moves clockwise in the high-speed advance action and indicates the day of the week, as shown in a state 4. The sub-hour/minute hand 63 then moves in the high-speed advance action and indicates the hour and minute of the world time. The display state thus returns to the normal display state.

When the A button 4 is pressed in the state 2, the first indicating hand 21 may instead move and point one of "L", "M", and "H", which represent the charge level, and when the A button 4 is pressed in this state, the first indicating hand 21 may move and indicate the day of the week.

Mode Switch Action in the Case where B Button is Pressed

When the B button 5 is pressed in any of the states 1 to 4, the mode of the timepiece is switched to the chronograph mode.

Figure 10:
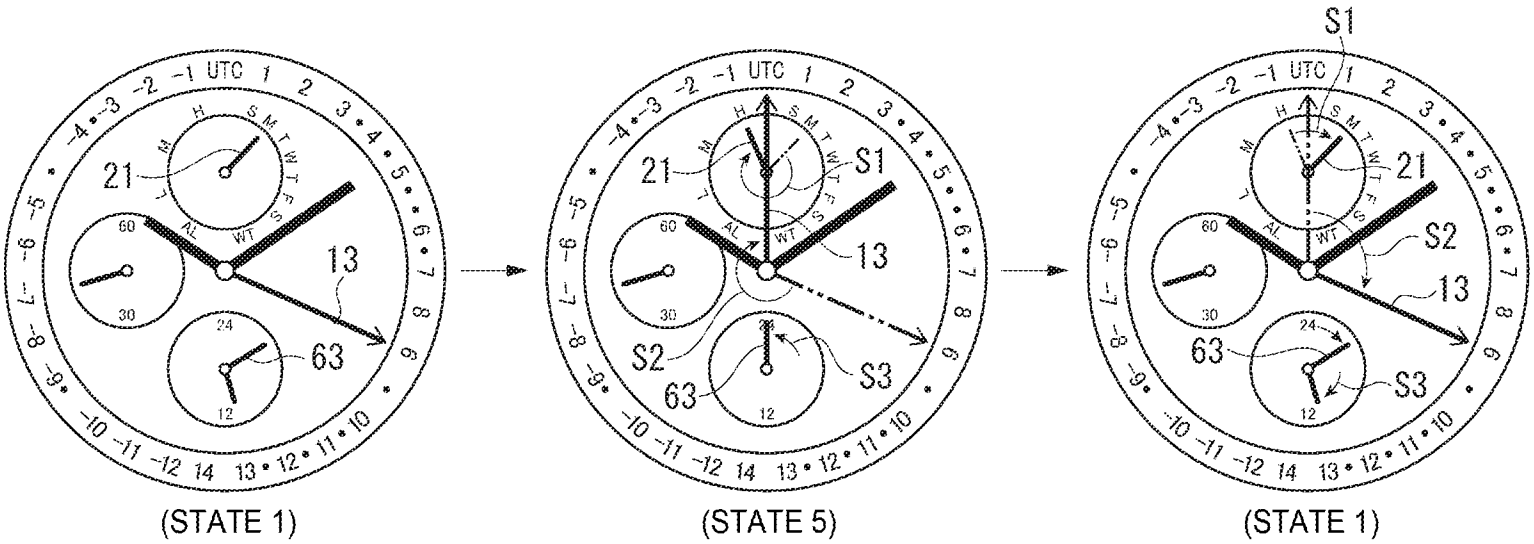
FIG. 10 shows an example of transition of the display state in a case where the B button of the analog electronic timepiece according to the second embodiment is pressed.

FIG. 10 shows an example of transition of the display state in a case where the B button 5 is pressed in the state 1.

When the B button 5 is pressed, the first indicating hand 21 moves in the high-speed advance action and indicates the charge level, as shown in a state 5 in FIG. 10. The first indicating hand 21 points the charge level to indicate the chronograph mode. In a case where "CHR" representing the chronograph mode is written on the dial, as in the first embodiment, the first indicating hand 21 may point "CHR" to indicate the chronograph mode.

After the first indicating hand 21 moves in the high-speed advance action, the second indicating hand 13 moves clockwise in the high-speed advance action and points the 0-second position.

After the second indicating hand 13 moves in the high-speed advance action, the sub-hour/minute hand 63 moves in the high-speed advance action and points the 0-hour/minute position.

When the A button 4 is pressed and the chronograph section 582 starts measurement, the second indicating hand 13 and the sub-hour/minute hand 63 operate at the normal speed and indicate the second, minute, and hour of the measured period.

The hour hand 11, the minute hand 12, and the second hand 31 keep operating at the normal speed and indicating the hour, minute, and second of the current time.

In a case where the A button 4 is pressed immediately after the B button 5 is pressed so that the chronograph section 582 starts measurement, and the second of the measured period has advanced before the second indicating hand 13 moves to the 0-second position, the second indicating hand 13 moves in the high-speed advance action to the position representing the second of the measured period. The second indicating hand 13 then keeps operating at the normal speed and indicating the second of the measured period.

After the second indicating hand 13 moves in the high-speed advance action, the sub-hour/minute hand 63 moves in the high-speed advance action and points the 0-hour/minute position. The sub-hour/minute hand 63 then operates at the normal speed and indicates the hour and minute of the measured period.

When the B button 5 is pressed again, the first indicating hand 21, the second indicating hand 13, and the sub-hour/minute hand 63 return to the display state before the B button 5 was pressed for the first time. In this process, the first indicating hand 21 first moves in the high-speed advance action, the second indicating hand 13 then moves in the high-speed advance action, and the sub-hour/minute hand 63 finally moves in the high-speed advance action.

The same configuration of the second embodiment as that of the first embodiment also allows the second embodiment to provide the same advantageous effects provided by the first embodiment.

Further, since the second indicating hand 13, which is the center hand, displays a time difference, the time difference can be displayed in an intelligible manner.

Moreover, when the B button 5 is pressed and the mode of the timepiece transitions to the chronograph mode, the first indicating hand 21 indicates the charge level. The user can therefore decide not to perform period measurement when the charge level is low. Power consumption resulting from period measurement performed at a low charge level can therefore be avoided.

Third Embodiment

An analog electronic timepiece 1B according to a third embodiment will be described. In the analog electronic timepiece 1B, the same configurations as those of the analog electronic timepiece 1A according to the second embodiment will not be described.

Figure 11:
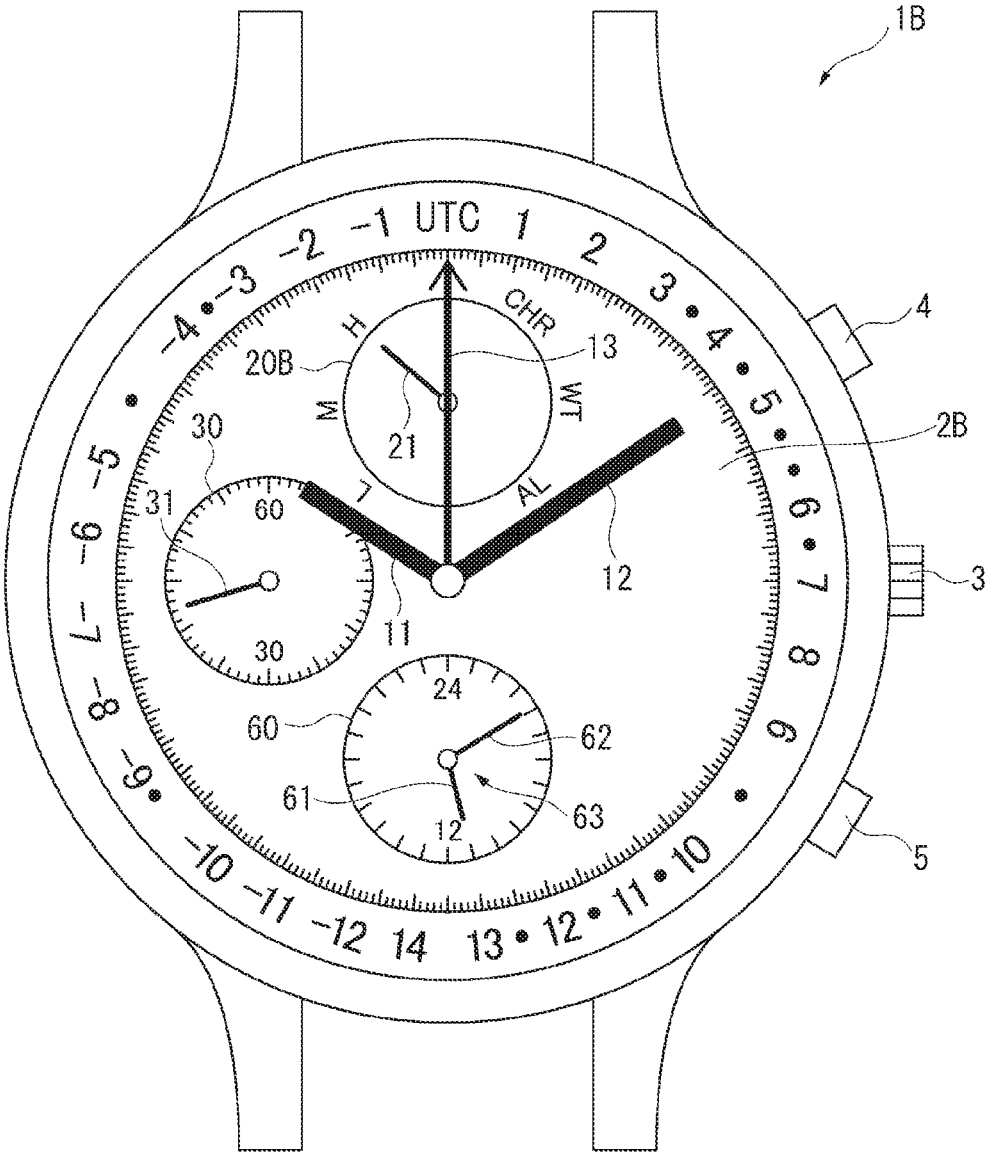
FIG. 11 is a front view of an analog electronic timepiece according to a third embodiment of the invention.

In the analog electronic timepiece 1B, the letters "CHR" representing the chronograph function, "WT" representing the world time setting function, representing the alarm function, and "L", "M", and "H" representing the charge level are written around a first small window 20B, as shown in FIG. 11.

In the analog electronic timepiece 1B, when the B button 5 is pressed, the mode of the timepiece is switched. When the A button 4 is pressed, the mode transitions to the chronograph mode, and the chronograph section 582 starts measuring a period.

In the analog electronic timepiece 1B, the number of motor drive pulses required for each of the first indicating hand 21, the second indicating hand 13, and the sub-hour/minute hand 63 to go around and the period required for each of the hands to go around in the high-speed advance action are equal to those in the analog electronic timepiece 1A according to the second embodiment.

Mode Switch Action in the Case where B Button is Pressed

Figure 12:
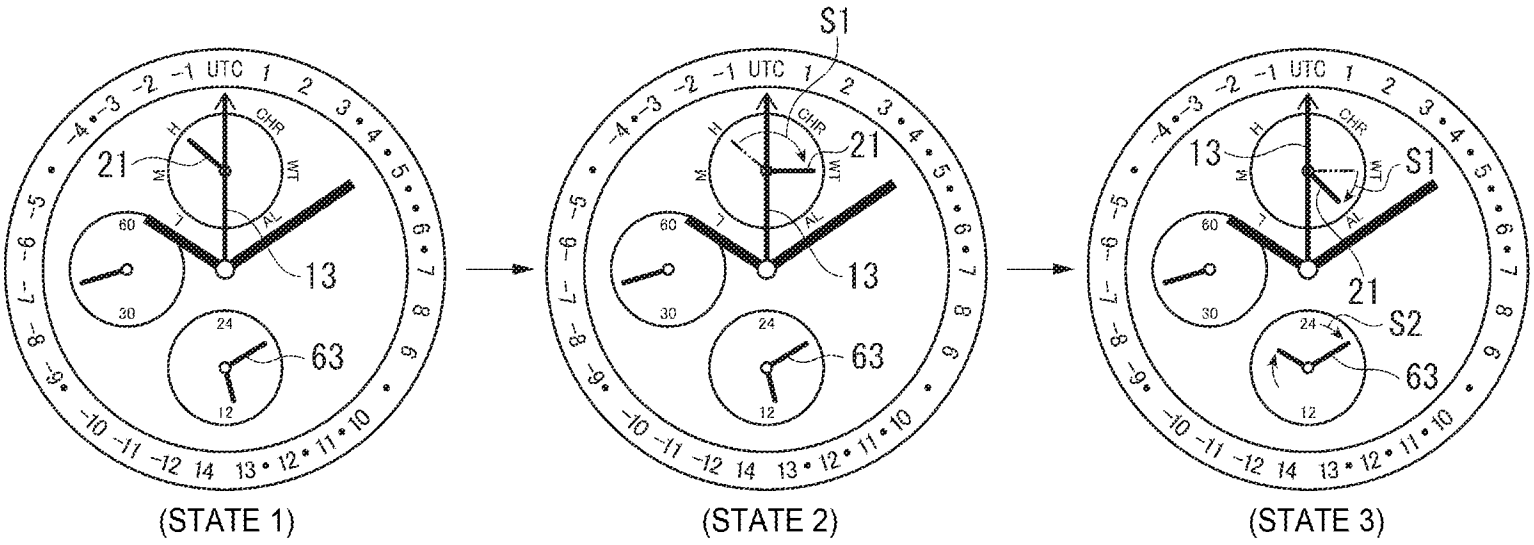
FIG. 12 shows an example of transition of the display state in a case where the B button of the analog electronic timepiece according to the third embodiment is pressed.

In the normal display state, the indicating hands 11, 12, and 31 indicate the hour, minute, and second of the current time, the first indicating hand 21 indicates the charge level, the second indicating hand 13 points the 0-second position, and the sub-hour/minute hand 63 indicates the hour and minute of the world time, as shown in a state 1 in FIG. 12. Even when the B button 5 is pressed, the indicating hands 11, 12, and 31 keep operating at the normal speed and indicating the hour, minute, and second of the current time, and the second indicating hand 13 keeps indicating the 0-second position.

When the B button 5 is pressed in the state 1, the first indicating hand 21 moves clockwise in the high-speed advance action and points "WT", which represents the world time setting function, as shown in a state 2. The sub-hour/minute hand 63 keeps indicating the hour and minute of the world time.

When the B button 5 is pressed in the state 2, the first indicating hand 21 moves clockwise in the high-speed advance action and points "AL", which represents the alarm function, as shown in a state 3. The sub-hour/minute hand 63 then moves in the high-speed advance action and indicates the hour and minute of alarm time.

When the B button 5 is pressed in the state 3, the first indicating hand 21 moves clockwise in the high-speed advance action and indicates the charge level, as shown in the state 1. The sub-hour/minute hand 63 then moves in the high-speed advance action and indicates the hour and minute of the world time. The display state thus returns to the normal display state.

Mode Switch Action in the Case where A Button is Pressed

When the A button 4 is pressed in any of the states 1 to 3, the mode of the timepiece is switched to the chronograph mode.

Figure 13:
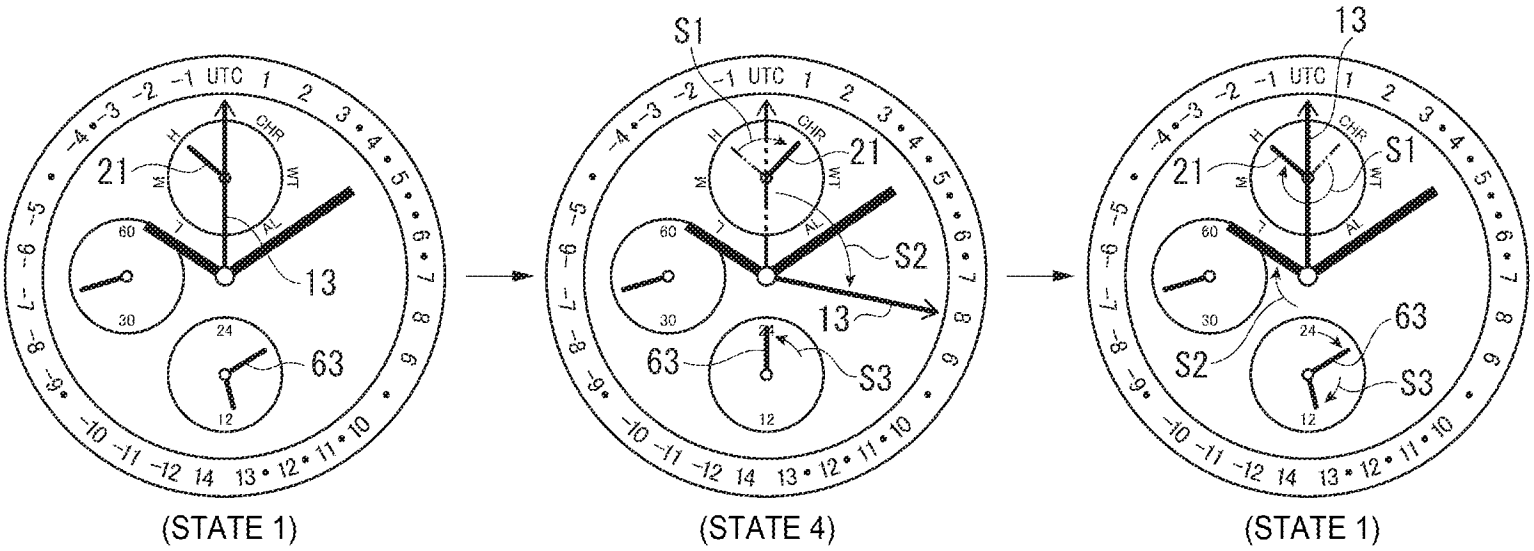
FIG. 13 shows an example of transition of the display state in a case where the A button of the analog electronic timepiece according to the third embodiment is pressed.

FIG. 13 shows an example of transition of the display state in a case where the A button 4 is pressed in the state 1.

When the A button 4 is pressed, the chronograph section 582 starts measurement, and the second indicating hand 13, which was stationary in the 0-second position, starts operating at the normal speed and indicates the second of the measured period, as shown in a state 4 in FIG. 13. At the same time, the first indicating hand 21 moves clockwise in the high-speed advance action and points "CHR," which represents the chronograph function.

After the first indicating hand 21 moves in the high-speed advance action, the sub-hour/minute hand 63 moves in the high-speed advance action and points the 0-hour/minute position. The sub-hour/minute hand 63 then operates at the normal speed and indicates the hour and minute of the measured period. When the A button 4 is pressed again, the chronograph section 582 stops the measurement.

Thereafter, when the B button 5 is pressed, the first indicating hand 21 and the sub-hour/minute hand 63 return to the display state before the A button 4 was pressed. In this process, the first indicating hand 21 first moves in the high-speed advance action, the second indicating hand 13 then moves in the high-speed advance action, and the sub-hour/minute hand 63 finally moves in the high-speed advance action.

The same configuration of the third embodiment as that of the second embodiment also allows the third embodiment to provide the same advantageous effects provided by the second embodiment.

Further, the second indicating hand 13 keeps being located in the 0-second position and can therefore quickly operate and indicate the second of a measured period when the A button 4 is pressed. The user can therefore immediately start measurement as compared with a case where the user performs button operation of switching the mode of the timepiece to the chronograph mode and then performs button operation of starting measurement.

Moreover, the sub-hour/minute hand 63 moves to the 0-hour/minute position before the minute of a measured period advances and can therefore display the minute of the measured period from the timing at which the minute advances for the first time. The measured period can therefore be correctly displayed immediately after the A button 4 is pressed.

Fourth Embodiment

An analog electronic timepiece 1C according to a fourth embodiment will be described. In the analog electronic timepiece 1C, the same configurations as those of the analog electronic timepiece 1 according to the first embodiment will not be described.

The analog electronic timepiece 1C has the same functions as those of the analog electronic timepiece 1 according to the first embodiment except that the analog electronic timepiece 1C has no function of displaying calendar information on the date, month, and year.

Figure 14:
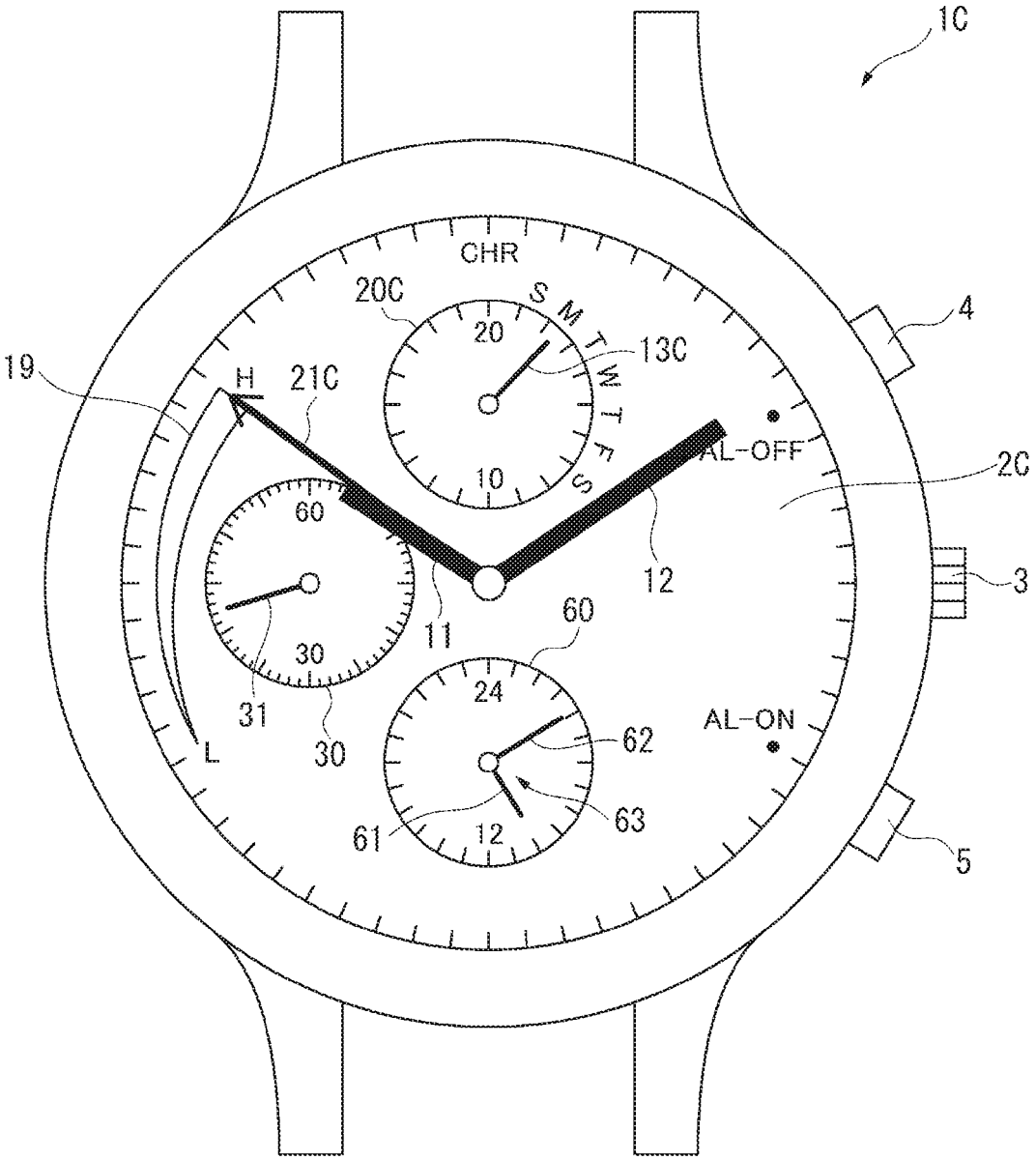
FIG. 14 is a front view of an analog electronic timepiece according to a fourth embodiment of the invention.

Further, in the analog electronic timepiece 1C, a first indicating hand 21C is formed of a center hand having an axis of rotation located at the center of a dial 2C, as shown in FIG. 14. A second indicating hand 13C is located in a first small window 20C.

An indicator 19, which represents the charge level of the secondary battery 7, is written on the peripheral surface of the dial 2C, as shown in FIG. 14. The first indicating hand 21C points any location on the indicator 19 to indicate the charge level of the secondary battery 7. That is, the first indicating hand 21C points any location on the indicator 19 to indicate that the type of displayed information is the charge level.

Letters "CHR" representing the chronograph function are further written on the peripheral surface of the dial 2C. The first indicating hand 21C points "CHR" to indicate the chronograph mode.

A symbol "Al-ON" representing that the alarm function is in operation and a symbol "AL-OFF" representing that the alarm function is not in operation are further written on the peripheral surface of the dial 2C. The first indicating hand 21C points one of "AL-ON" and "AL-OFF" to indicate that the mode of the timepiece is an alarm time setting mode.

Markings that divide the outer circumference into 20 divisions are written on the peripheral surface of the first small window 20C. The second indicating hand 13C uses these markings to indicate the second of a measured period measured by the chronograph section 582 on a 1/20-second basis. Letters "S" to "S", which represent the seven days of the week, are written around the first small window 20C. The second indicating hand 13C points any of "S" to "S" to indicate the day of the week.

The sub-hour/minute hand 63 indicates the current time, the alarm time, and the hour and minute of a measured period measured by the chronograph section 582. Instead of the current time, the sub-hour/minute hand 63 may indicate time other than the current time. The time other than the current time is time set by the user and is, for example, time different from the current time by a time difference (time zone) or time that is ahead of the current time, for example, by 10 minutes.

Period Required to Move Each Indicating Hand

FIG. 15 shows the number of motor drive pulses required for each of the first indicating hand 21C, the second indicating hand 13C, and the sub-hour/minute hand 63 to go around and further shows a period required for each of the hands to go around in the high-speed advance action.

FIG. 15 shows a case where each of the indicating hands is advanced at high speed with motor drive pulses of a frequency of 85 Hz.

The number of pulses required for the first indicating hand 21C to go around is 300, and the period required for the first indicating hand 21C to go around in the high-speed advance action is 3.5 seconds.

The number of pulses required for the second indicating hand 13C to go around is 60, and the period required for the second indicating hand 13C to go around in the high-speed advance action is 0.7 seconds.

The number of pulses required for the sub-hour/minute hand 63 to go around is 1440, and the period required for the sub-hour/minute hand 63 to go around in the high-speed advance action is 16.9 seconds.

That is, in the high-speed advance action, the second indicating hand 13C goes around in the shortest period, the first indicating hand 21C goes around in the second shortest period, and the sub-hour/minute hand 63 goes around in the longest period.

In the analog electronic timepiece 1C, when the A button 4 is pressed, the mode of the timepiece is switched from one to another, and when the B button 5 is pressed, the mode transitions to the chronograph mode.

Mode Switch Action in the Case where A Button is Pressed

Figure 16:
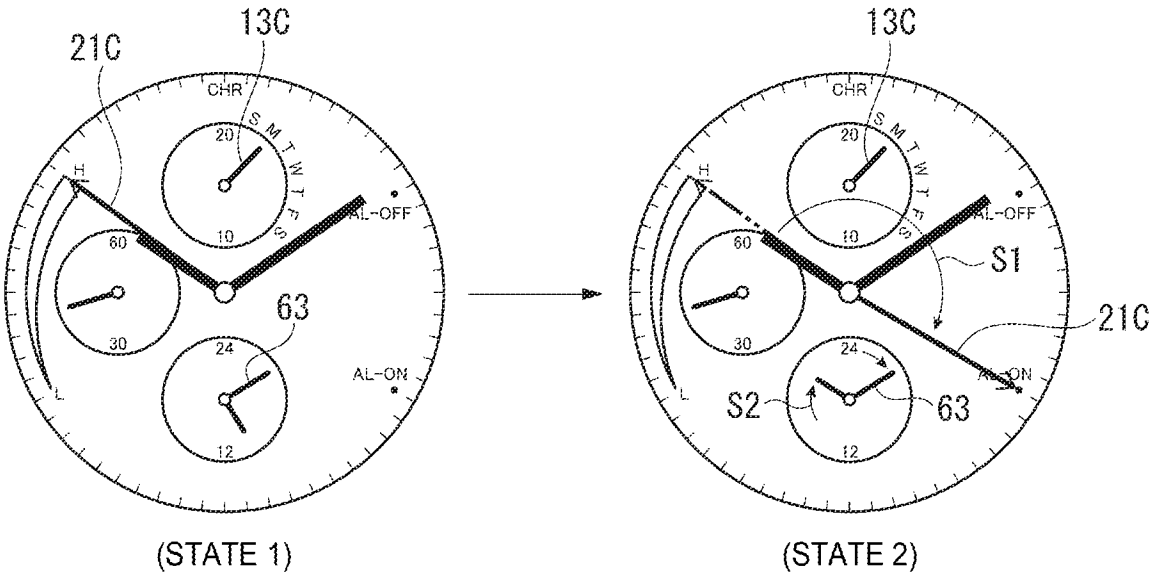
FIG. 16 shows an example of transition of the display state in a case where the A button of an analog electronic timepiece according to the fourth embodiment is pressed.

In the normal display state, the indicating hands 11, 12, and 31 indicate the hour, minute, and second of the current time, the first indicating hand 21C indicates the charge level, the second indicating hand 13C indicates the day of the week, and the sub-hour/minute hand 63 indicates the hour and minute of the current time, as shown in a state 1 in FIG. 16. Even when the A button 4 is pressed, the indicating hands 11, 12, and 31 keep operating at the normal speed and indicating the hour, minute, and second of the current time.

When the A button 4 is pressed in the state 1, the first indicating hand 21C moves clockwise in the high-speed advance action and points "Al-ON" representing that the alarm function is in operation or "AL-OFF" representing that the alarm function is not in operation, as shown in a state 2.

When the first indicating hand 21C points "Al-ON," the sub-hour/minute hand 63 moves, after the first indicating hand 21C moves, in the high-speed advance action and indicates the hour and minute of alarm time. The second indicating hand 13C keeps indicating the day of the week. From this state, when the user so rotates the crown 3 to move the sub-hour/minute hand 63 as to coincide with the time having been indicated with the sub-hour/minute hand 63, the alarm function stops, and the first indicating hand 21C moves and points "AL-OFF".

When the A button 4 is pressed in the state 1 and the first indicating hand 21C moves and points "AL-OFF", the sub-hour/minute hand 63 keeps indicating the hour and minute of the current time or after the first indicating hand 21C moves, the sub-hour/minute hand 63 moves in the high-speed advance action and indicates the hour and minute of time set in advance by the user. The second indicating hand 13C keeps indicating the day of the week. From this state, when the user so rotates the crown 3 to move the sub-hour/minute hand 63 as to shift from the current time or the time set by the user, the alarm function is activated and alarm time is set, and the first indicating hand 21C moves and points "AL-ON".

The switching of the action state of the alarm function between activated or deactivated and the setting of alarm time may instead be performed through button operation instead of the rotation of the crown 3. For example, the user may pull the crown 3 out to the first-step position and press the A button 4 to switch the action state of the alarm function and switch the symbol pointed with the first indicating hand 21C to "AL-ON" or "AL-OFF". Still instead, in the state in which the crown 3 is pulled out to the first-step position, the user may set alarm time by pressing the B button 5 to rotate the sub-hour/minute hand 63 in the normal direction for alarm time adjustment and pushing the crown 3 to the zeroth-step position.

When the A button 4 is pressed in the state 2, the first indicating hand 21C moves clockwise in the high-speed advance action and indicates the charge level, as shown in the state 1. The sub-hour/minute hand 63 then moves in the high-speed advance action and indicates the hour and minute of the current time. The display state thus returns to the normal display state.

Display Switch Action in the Case where B Button is Pressed

When the B button 5 is pressed in the state 1 or 2, the mode of the timepiece is switched to the chronograph mode.

Figure 17:
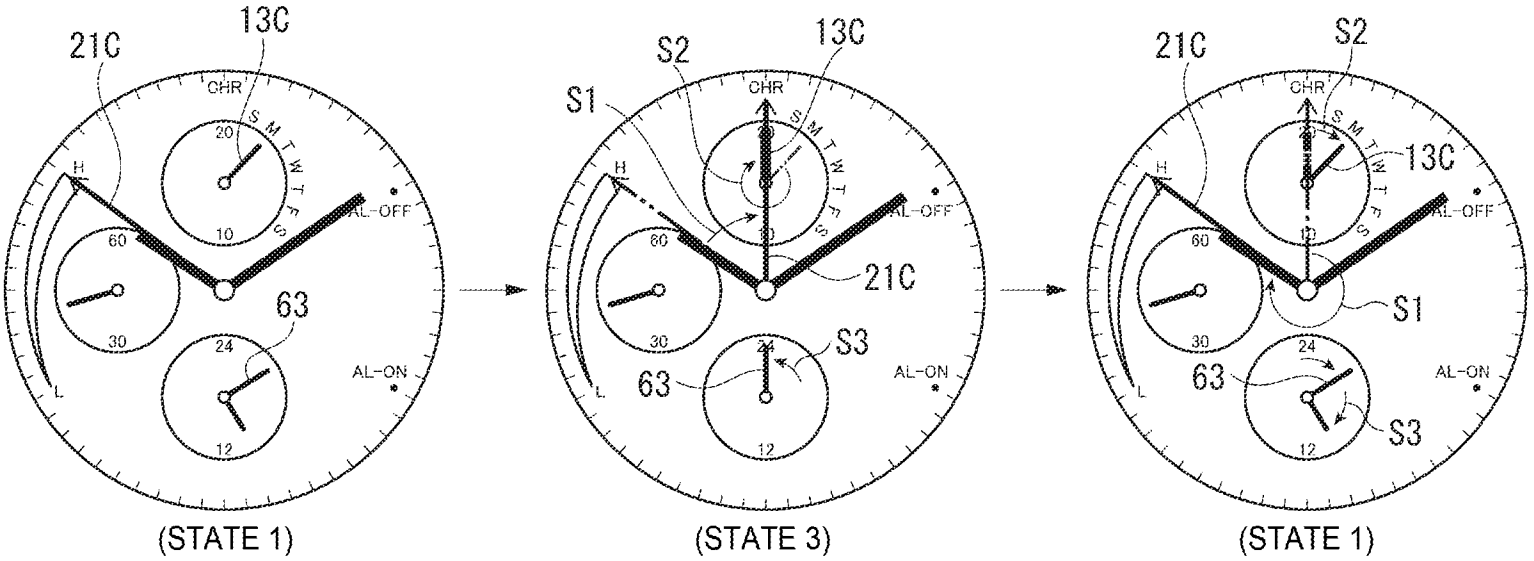
FIG. 17 shows an example of transition of the display state in a case where the B button of the analog electronic timepiece according to the fourth embodiment is pressed.

FIG. 17 shows an example of transition of the display state in a case where the B button 5 is pressed in the state 1.

When the B button 5 is pressed, the first indicating hand 21C moves clockwise in the high-speed advance action and points "CHR" representing the chronograph function, as shown in a state 3 in FIG. 17.

After the first indicating hand 21C moves in the high-speed advance action, the second indicating hand 13C moves clockwise in the high-speed advance action and points the 0-second position.

After the second indicating hand 13C moves in the high-speed advance action, the sub-hour/minute hand 63 moves in the high-speed advance action and points the 0-hour/minute position.

When the A button 4 is then pressed and the chronograph section 582 starts measurement, the second indicating hand 13C and the sub-hour/minute hand 63 operate at the normal speed and indicate the hour, minute, and second of the measured period.

The hour hand 11, the minute hand 12, and the second hand 31 keep operating at the normal speed and indicating the hour, minute, and second of the current time.

In a case where the A button 4 is pressed immediately after the B button 5 is pressed so that the chronograph section 582 starts measurement, and the second of the measured period has advanced before the second indicating hand 13C moves to the 0-second position, the second indicating hand 13C moves in the high-speed advance action to the position representing the second of the measured period. The second indicating hand 13C then keeps operating at the normal speed and indicating the second of the measured period.

After the second indicating hand 13C moves in the high-speed advance action, the sub-hour/minute hand 63 moves in the high-speed advance action and points the 0-hour/minute position. The sub-hour/minute hand 63 then operates at the normal speed and indicates the hour and minute of the measured period. When the A button 4 is pressed again, the chronograph section 582 stops the measurement.

Thereafter, when the B button 5 is pressed, the first indicating hand 21C, the second indicating hand 13C, and the sub-hour/minute hand 63 return to the display state before the B button 5 was pressed for the first time. In this process, the first indicating hand 21C first moves in the high-speed advance action, the second indicating hand 13C then moves in the high-speed advance action, and the sub-hour/minute hand 63 finally moves in the high-speed advance action.

The same configuration of the fourth embodiment as that of the first embodiment also allows the fourth embodiment to provide the same advantageous effects provided by the first embodiment.

The first indicating hand 21C, which indicates the type of displayed information, is formed of a center hand. Therefore, when the A button 4 is pressed, the first indicating hand 21C can be aggressively moved, whereby the exterior appearance of the timepiece can be improved.

Other Embodiments

The invention is not limited to the embodiments described above, and changes, improvements, and other modifications made to the embodiments to the extent that the advantage of some aspects of the invention can be achieved fall within the scope of the invention.

In each of the embodiments described above, the sub-hour hand 61 and the sub-minute hand 62 are provided in the third small window 60, but the invention is not necessarily configured this way. For example, only the sub-hour hand 61 may be provided or only the sub-minute hand 62 may be provided. The sub-hour/minute hand 63 may even be omitted.

In each of the embodiments described above, the sub-hour/minute hand 63 indicates time in the 24-hour clock, but the invention is not necessarily configured this way. For example, the sub-hour/minute hand 63 may indicate time in a 12-hour clock. In this case, an indicating hand that points AM and PM may be separately provided. The priority in accordance with which the indicating hand is moved in the high-speed advance action is also determined in accordance with the number of motor drive pulses required for the indicating hand to go around.

In the first to third embodiments described above, when the A button 4 or the B button 5 is pressed, the indicating hands are sequentially moved in ascending order of the number of motor drive pulses required for the indicating hands to go around, but the invention is not necessarily configured this way. For example, the indicating hands may be sequentially moved in ascending order of the number of pulses required for the indicating hands to move from the positions thereof located when the button is pressed to the destinations.

For example, in the first embodiment, in a case where the number of pulses required to move the second indicating hand 13 to the 0-second position is "10", and the number of pulses required to move the first indicating hand 21 to the "CHR" position is "20", when the B button 5 is pressed, the second indicating hand 13 may be moved before the first indicating hand 21.

In the fourth embodiment described above, when the B button 5 is pressed, the first indicating hand 21C is moved before the second indicating hand 13C, but the invention is not necessarily configured this way. That is, the second indicating hand 13C, which goes around with a fewer number of motor drive pulses than the number required for the first indicating hand 21C, may be moved before the first indicating hand 21C.

In each of the embodiments described above, the mode in which information displayed with each of the indicating hands is switched from one to another is not limited, for example, to the chronograph. For example, a perpetual calendar, dual time, a countdown timer, and an indicator may be combined with each other as appropriate. Further, the mode is not limited to a mode used by the user on a daily basis. For example, a mode in which the hand position is adjusted or a mode in which time is adjusted may be used.

The entire disclosure of Japanese Patent Application No. 2014-244847, filed Apr. 10, 2015 is expressly incorporated by reference herein.

What is claimed is:

1. An electronic timepiece having a plurality of modes, the timepiece comprising:

a plurality of indicating hands including a mode hand that indicates one of the modes;

an operation section that allows mode switching operation that instructs switching among the modes;

a display control section that moves the plurality of indicating hands based on the mode switching operation; and a plurality of motors that drive the plurality of indicating hands under the control of the display control section, the display control section moving the plurality of indicating hands in high-speed advance action, in which the plurality of indicating hands moves at a higher speed than a speed at which the plurality of indicating hands moves in a normal time display mode, while switching among the modes, with periods for which the plurality of indicating hands move in the high-speed advance action being non-overlapped with one another, the display control section first moving the mode hand among the plurality of indicating hands and then sequentially moving the other indicating hands in ascending order of motor drive pulses required for the plurality of indicating hands to go around while switching among the modes.

2. An electronic timepiece having a plurality of modes, the timepiece comprising:

a plurality of indicating hands including a mode hand that indicates one of the modes;

an operation section that allows mode switching operation that instructs switching among the modes;

a display control section that moves the plurality of indicating hands based on the mode switching operation, with periods for which the plurality of indicating hands move in high-speed advance action being non-overlapped with one another, the plurality of indicating hands moves at a higher speed in the high-speed advance action than a speed at which the plurality of indicating hands moves in a normal time display mode; and a chronograph section that measures a time period, the display control section first moving the mode hand among the plurality of indicating hands, the plurality of indicating hands including a plurality of measurement indicating hands corresponding to a plurality of units of time, respectively, with the measurement indicating hands indicating the time period measured by the chronograph section, and the display control section moving the mode hand based on chronograph switching operation that is performed through the operation section and instructs measurement of the time period, and the display control section, after moving the mode hand, first moving one of the measurement indicating hands that corresponds to a smallest unit of time among the plurality of units of time.

3. The electronic timepiece according to claim 2, wherein when the chronograph section starts measuring the time period before the movement of the one of the measurement indicating hands is completed, the display control section moves the one of the measurement indicating hands in the high-speed advance action to a position representing the time period and then allows the one of the measurement indicating hands to normally operate.

4. An electronic timepiece having a plurality of modes, the timepiece comprising:

a plurality of indicating hands;

a plurality of motors that drive the plurality of indicating hands;

an operation section that allows mode switching operation that instructs switching among modes; and a display control section that moves the plurality of indicating hands in high-speed advance action, in which the plurality of indicating hands moves at a higher speed than a speed at which the plurality of indicating hands moves in a normal time display mode, by using the plurality of motors based on the mode switching operation, the display control section sequentially moving the plurality of indicating hands in ascending order of motor drive pulses required for the plurality of indicating hands to go around, with periods for which the indicating hands move in the high-speed advance action being non-overlapped with one another.

* * * * *